US011795531B2

(12) United States Patent
Yoshitomi et al.

(10) Patent No.: US 11,795,531 B2
(45) **Date of Patent: *Oct. 24, 2023**

(54) HIGH-STRENGTH GALVANIZED STEEL SHEET, HIGH STRENGTH MEMBER, AND METHOD FOR MANUFACTURING THE SAME

(71) Applicant: JFE Steel Corporation, Tokyo (JP)

(72) Inventors: Hiromi Yoshitomi, Tokyo (JP); Yoshihiko Ono, Tokyo (JP); Tatsuya Nakagaito, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 232 days.

This patent is subject to a terminal disclaimer.

(21) Appl. No.: 17/042,521

(22) PCT Filed: Mar. 29, 2019

(86) PCT No.: PCT/JP2019/014221
§ 371 (c)(1),
(2) Date: Sep. 28, 2020

(87) PCT Pub. No.: WO2019/189842
PCT Pub. Date: Oct. 3, 2019

(65) Prior Publication Data

US 2021/0010115 A1 Jan. 14, 2021

(30) Foreign Application Priority Data

Mar. 30, 2018 (JP) ..... 2018-068994

(51) Int. Cl.
*C22C 38/50* (2006.01)
*C21D 8/02* (2006.01)
(Continued)

(52) U.S. Cl.
CPC ..... *C22C 38/50* (2013.01); *C21D 8/0205* (2013.01); *C21D 8/0236* (2013.01); *C21D 9/46* (2013.01);
(Continued)

(58) Field of Classification Search
CPC ..... C21D 1/76; C21D 8/0205; C21D 8/0236; C21D 8/0247; C21D 8/0405;
(Continued)

(56) References Cited

U.S. PATENT DOCUMENTS 9,611,524 B2 4/2017 Hamada et al.
11,408,059 B2 * 8/2022 Yoshitomi ..... C23C 2/40
(Continued)

FOREIGN PATENT DOCUMENTS

CN 101082100 A 12/2007
CN 104508163 A 4/2015
(Continued)

OTHER PUBLICATIONS

NPL: on-line translation of JP-2008261027-A, Oct. 2008 (Year: 2008).*
(Continued)

*Primary Examiner* — Jie Yang
(74) *Attorney, Agent, or Firm* — RatnerPrestia

(57) ABSTRACT

A high-strength galvanized steel sheet of the present invention includes a steel sheet having a specific chemical composition, and a steel structure containing, in terms of area ratio, 4% or more and 20% or less of retained austenite, 30% or less (including 0%) of ferrite, 40% or more of martensite, and 10% or more and 50% or less of bainite; and a galvanized layer provided on the steel sheet, in which an amount of diffusible hydrogen in the steel is less than 0.20 mass ppm, a tensile strength is 1100 MPa or more, a relationship between a tensile strength TS (MPa), an elon-
(Continued)

gation El (%), and a sheet thickness t (mm) satisfies a (1) formula below, and a yield ratio YR is 67% or more.

$$TS \times (El+3-2.5t) \geq 13000 \quad (1)$$

20 Claims, 1 Drawing Sheet

(51) Int. Cl.

| | |
|---|---|
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |

(52) U.S. Cl.
CPC ..... *C22C 38/001* (2013.01); *C22C 38/002* (2013.01); *C22C 38/04* (2013.01); *C22C 38/06* (2013.01); *C22C 38/42* (2013.01); *C22C 38/44* (2013.01); *C22C 38/46* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 8/0436; C21D 8/0447; C21D 9/46; C21D 9/48; C22C 18/00; C22C 38/00; C23C 2/06; C23C 2/26; C23C 2/40; C23G 1/08
USPC ..... 420/61
See application file for complete search history.

(56) References Cited

U.S. PATENT DOCUMENTS

| | | | | |
|---|---|---|---|---|
| 11,427,880 | B2 * | 8/2022 | Yoshitomi | C22C 38/06 |
| 2006/0137768 | A1 * | 6/2006 | Yuse | C22C 38/12 420/103 |
| 2008/0023112 | A1 | 1/2008 | Kashima | |
| 2014/0234658 | A1 | 8/2014 | Nozaki et al. | |
| 2016/0214351 | A1 | 7/2016 | Harako et al. | |
| 2017/0218475 | A1 | 8/2017 | Kawasaki et al. | |
| 2018/0298462 | A1 | 10/2018 | Sano et al. | |
| 2019/0032187 | A1 | 1/2019 | Yoshitomi et al. | |
| 2020/0032364 | A1 | 1/2020 | Hirashima et al. | |
| 2020/0190617 | A1 | 6/2020 | Hasegawa et al. | |
| 2020/0291499 | A1 | 9/2020 | Yoshitomi et al. | |
| 2020/0377978 | A1 | 12/2020 | Yoshitomi et al. | |
| 2021/0115529 | A1 | 4/2021 | Yoshitomi et al. | |
| 2022/0251676 | A1 * | 8/2022 | Minami | C21D 9/46 |

FOREIGN PATENT DOCUMENTS

| | | | | |
|---|---|---|---|---|
| CN | 106164313 | A | 11/2016 | |
| CN | 107208205 | A | 9/2017 | |
| EP | 2474639 | A1 | 7/2012 | |
| EP | 2762583 | A1 | 8/2014 | |
| EP | 2762602 | A1 | 8/2014 | |
| EP | 2881481 | A1 | 6/2015 | |
| EP | 3040440 | A1 | 7/2016 | |
| EP | 3101147 | A1 * | 12/2016 | C21D 1/20 |
| EP | 3128023 | A1 | 2/2017 | |
| EP | 3187607 | A1 | 7/2017 | |
| EP | 3239343 | A1 | 11/2017 | |
| EP | 3243923 | A1 | 11/2017 | |
| EP | 3409807 | A1 | 12/2018 | |
| JP | 2006037130 | A * | 2/2006 | |
| JP | 2006207018 | A | 8/2006 | |
| JP | 2007197819 | A | 8/2007 | |
| JP | 2007231373 | A | 9/2007 | |
| JP | 2008261027 | A * | 10/2008 | |
| JP | 2011111671 | A | 6/2011 | |
| JP | 2011111675 | A | 6/2011 | |
| JP | 2011190474 | A | 9/2011 | |
| JP | 2013213232 | A | 10/2013 | |
| JP | 2015151607 | A | 8/2015 | |
| JP | 2016191125 | A | 11/2016 | |
| JP | 2017133102 | A | 8/2017 | |
| JP | 2017145441 | A | 8/2017 | |
| JP | 6526114 | B1 | 6/2019 | |
| KR | 20160072898 | A | 6/2016 | |
| WO | 2004063410 | A1 | 7/2004 | |
| WO | 2013047836 | A1 | 4/2013 | |
| WO | 2015029404 | A1 | 3/2015 | |
| WO | 2016199922 | A1 | 12/2016 | |
| WO | 2017131055 | A1 | 8/2017 | |
| WO | 2017131056 | A1 | 8/2017 | |
| WO | 2018124157 | A1 | 7/2018 | |
| WO | 2018146828 | A1 | 8/2018 | |

OTHER PUBLICATIONS

NPL: on-line translation of JP 2006037130 A, Feb. 2006 (Year: 2006).*
Chinese Office Action for Chinese Application No. 201980023902.8, dated Dec. 16, 2021, with Concise Statement of Relevance of Office Action, 6 pages.
Chinese Office Action with Search Report for Chinese Application No. 201980023902.8, dated May 19, 2021, 9 pages.
Chinese Office Action for Chinese Application No. 201980023902.8, dated Aug. 31, 2021, with Concise Statement of Relevance of Office Action, 7 pages.
International Search Report and Written Opinion for International Application No. PCT/JP2019/014221, dated Jun. 25, 2019, 6 pages.
Extended European Search Report for European Application No. 19 776 138.0, dated Nov. 5, 2020, 14 pages.
Non Final Office Action for U.S. Appl. No. 16/960,733, dated May 23, 2022. 27 pages.
Chinese Office Action for Application No. 201980023902.8, dated May 18, 2022 with Concise Statement of Relevance of Office Action, 7 pages.
Non Final Office Action for U.S. Appl. No. 16/765,708, dated Mar. 17, 2022, 12 pages.
Non Final Office Action for U.S. Appl. No. 16/766,398, dated Jan. 21, 2022, 9 pages.
Chinese Office Action with Search Report for Chinese Application No. 202211046507.1, dated Jul. 17, 2023, 14 pages.

* cited by examiner

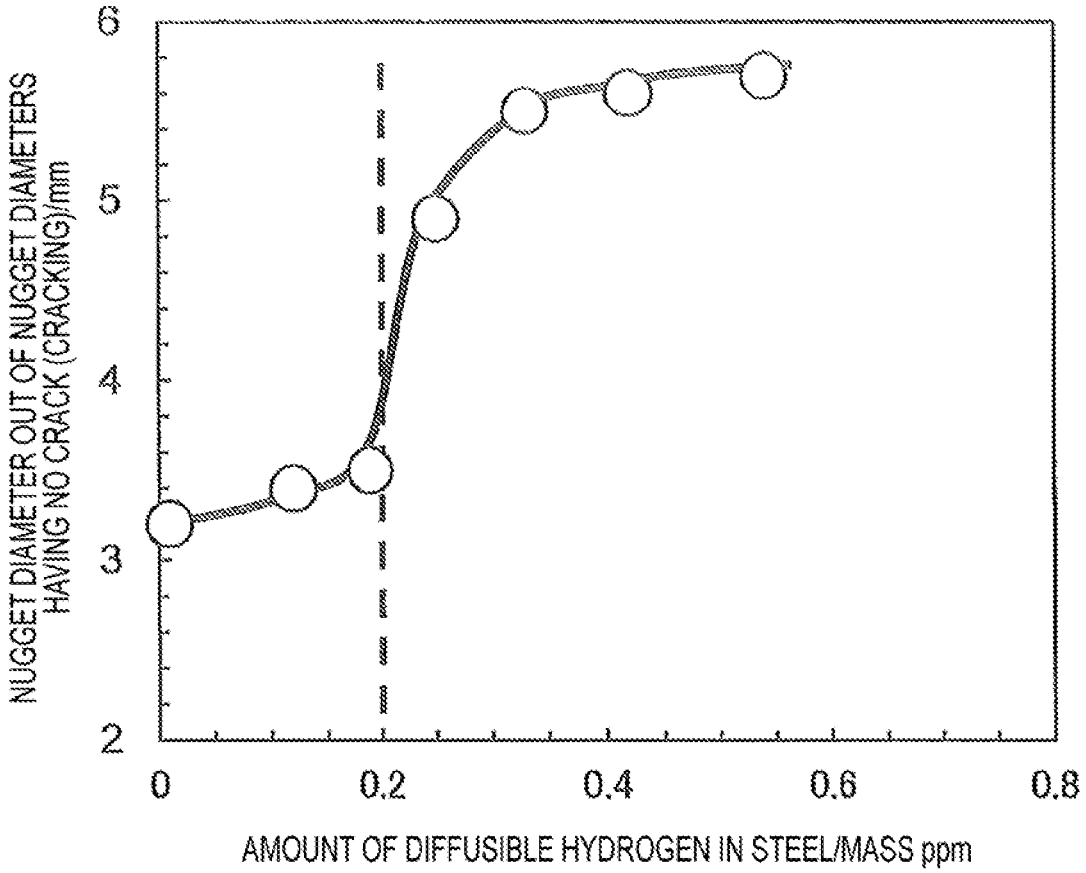
NUGGET DIAMETER OUT OF NUGGET DIAMETERS HAVING NO CRACK (CRACKING)/mm
6
5
4
3
2
0
0.2
0.4
0.6
0.8
AMOUNT OF DIFFUSIBLE HYDROGEN IN STEEL/MASS ppm

HIGH-STRENGTH GALVANIZED STEEL SHEET, HIGH STRENGTH MEMBER, AND METHOD FOR MANUFACTURING THE SAME

CROSS REFERENCE TO RELATED APPLICATIONS

This is the U.S. National Phase application of PCT/JP2019/014221, filed Mar. 29, 2019, which claims priority to Japanese Patent Application No. 2018-068994, filed Mar. 30, 2018, the disclosures of these applications being incorporated herein by reference in their entireties for all purposes.

FIELD OF THE INVENTION

The present invention relates to a high-strength galvanized steel sheet and a high strength member that are excellent in elongation (El) and hydrogen embrittlement resistance, which become more likely to be degraded as strength becomes higher, and are suitable for building materials and frame members and collision resistant members of automobiles, and a method for manufacturing them.

BACKGROUND OF THE INVENTION

In these days when collision safety and fuel efficiency improvement of automobiles are strongly required, the strength increase of steel sheets that are materials of parts is being advanced. Among them, materials of parts used in and around the cabin are required to have not only high tensile strength but also high yield strength from the viewpoint of ensuring the safety of the occupant when the automobile collides. Further, not only the strength but also the ductility of the material is important in order to reflect designability. Further, in view of the fact that automobiles are being widely spread on a global scale and automobiles are used for various uses in diverse areas and climates, steel sheets that are materials of parts are required to have high antirust properties. Literatures regarding characteristics such as high strength include Patent Literatures 1 to 3 below.

Patent Literature 1 discloses a method of providing a steel sheet that has a tensile strength of 980 MPa or more, and is excellent in strength-ductility balance.

Further, Patent Literature 2 discloses a high-strength hot-dip galvanized steel sheet that uses, as a matrix, a high-strength steel sheet containing Si and Mn and is excellent in coating external appearance, corrosion resistance, exfoliation resistance and formability during high processing, and a method for manufacturing the same.

Further, Patent Literature 3 discloses a method for manufacturing a high-strength galvanized steel sheet having excellent delayed fracture resistance characteristics.

Meanwhile, the concern of hydrogen embrittlement arises in association with the strength increase of the steel sheet. As literatures regarding this, for example, Patent Literatures 4, 5, and 6 disclose, as a steel sheet utilizing retained austenite having enhanced formability and hydrogen embrittlement resistance, a steel sheet that contains bainitic ferrite and martensite as base phases and contains retained austenite and in which hydrogen embrittlement resistance is enhanced by appropriately controlling the area ratio and the dispersion form of retained austenite. With a focus on bainitic ferrite and retained austenite, which have very high hydrogen trapping capacity and hydrogen occluding capacity, the form of retained austenite is set to a fine lath form of the submicron order in order to sufficiently exhibit particularly the effect of retained austenite.

Patent Literature 7 discloses a high-strength steel sheet that is made of a steel sheet with a base material strength (TS) of less than approximately 870 MPa and is excellent in hydrogen brittleness resistance of weld joints, and a method for manufacturing the same. Patent Literature 7 has improved hydrogen brittleness resistance by dispersing oxides in the steel.

Patent Literature

Patent Literature 1: JP 2013-213232 A
Patent Literature 2: JP 2015-151607 A
Patent Literature 3: JP 2011-111671 A
Patent Literature 4: JP 2007-197819 A
Patent Literature 5: JP 2006-207018 A
Patent Literature 6: JP 2011-190474 A
Patent Literature 7: JP 2007-231373 A

SUMMARY OF THE INVENTION

Thus far, what is called dual phase (DP) steel or TRIP steel excellent in ductility has had low yield strength (YS) with respect to tensile strength (TS), that is, has had a low yield ratio (YR). For a steel sheet with a small sheet thickness, even if hydrogen enters, it is released in a short time; thus, the critical mind to what is called delayed fracture has been low. The "steel sheet with a small sheet thickness" refers to a steel sheet with a sheet thickness of 3.0 mm or less.

In Patent Literature 1, although the addition of Si, which reduces adhesion property of coating, is suppressed, cases where the content of Mn is more than 2.0% encounter a situation where Mn-based oxides are likely to be formed on the surface of the steel sheet and coatability is generally impaired.

In Patent Literature 2, conditions at the time of forming a coating layer are not particularly limited but conditions usually used are employed, and coatability is poor. Further, hydrogen embrittlement resistance is not improved.

In Patent Literature 2, from the viewpoint of steel structure, it is hard to apply this technology for materials having $A_{c3}$ points more than 800° C. in terms of metal structure formation. Further, if the hydrogen concentration in an atmosphere in the furnace is high, the concentration of hydrogen in steel is increased, and hydrogen embrittlement resistance is poor.

In Patent Literature 3, although delayed fracture resistance property after processing is improved, the hydrogen concentration during annealing is high, and hydrogen remains in the base material itself and hydrogen embrittlement resistance is poor.

Patent Literatures 4 to 7 make improvement regarding hydrogen embrittlement resistance; however, these literatures are derived from hydrogen generated from a corrosive environment or atmosphere in a usage environment, and have not considered the hydrogen embrittlement resistance of the material before processing or during processing after manufacturing. In general, when coating of zinc, nickel, or the like is provided, hydrogen is less likely to be released from or incorporated into the material, and therefore hydrogen that enters the steel sheet during manufacturing is likely to remain in the steel and the hydrogen embrittlement of the material is likely to occur. In Patent Literature 7, in a case where the upper limit of the hydrogen concentration in a furnace of a continuous coating line is 60% and annealing is performed at a high temperature of the $A_{c3}$ point or more causes a large amount of hydrogen to be incorporated into the steel. Therefore, the method of Patent Literature 7 cannot manufacture an ultra-high-strength steel sheet excellent in hydrogen embrittlement resistance having TS≥1100 MPa.

An object according to aspects of the present invention is, for a high-strength galvanized steel sheet having concern with hydrogen embrittlement, to provide a high-strength galvanized steel sheet and a high strength member that are excellent in the coating external appearance and the hydrogen embrittlement resistance of the material, and have a high yield ratio suitable for building materials and automotive collision-resistant members, and a method for manufacturing the same.

In order to solve the issue mentioned above, the present inventors used various steel sheets to conduct studies for achieving both the possession of good mechanical properties in addition to good external appearance and the overcoming of the cracking of resistance spot weld nuggets, as coatability and hydrogen embrittlement resistance. As a result, construction of optimum steel structure and balance of mechanical properties are achieved and the amount of hydrogen in steel is controlled by means of appropriate adjustment of manufacturing conditions in addition to the chemical composition of the steel sheet; thus, the issue mentioned above has been solved. Specifically, aspects of the present invention provide the following.

[1] A high-strength galvanized steel sheet including:

a steel sheet having a chemical composition containing, in mass %,

C: 0.10% or more and 0.30% or less,

Si: 1.0% or more and 2.8% or less,

Mn: 2.0% or more and 3.5% or less,

P: 0.010% or less,

S: 0.001% or less,

Al: 1% or less,

N: 0.0001% or more and 0.006% or less, and the balance: Fe and incidental impurities, and a steel structure containing, in terms of area ratio, 4% or more and 20% or less of retained austenite, 30% or less (including 0%) of ferrite, 40% or more of martensite, and 10% or more and 50% or less of bainite; and a galvanized layer provided on the steel sheet, in which an amount of diffusible hydrogen in the steel is less than 0.20 mass ppm, a tensile strength is 1100 MPa or more, a relationship between a tensile strength TS (MPa), an elongation El (%), and a sheet thickness t (mm) satisfies a (1) formula below, and a yield ratio YR is 67% or more.

$$TS\times(El+3-2.5t)\geq 13000 \quad (1)$$

[2] The high-strength galvanized steel sheet according to [1], in which the chemical composition further contains at least one of, in mass %, one or more of Ti, Nb, V, and Zr: 0.005% or more and 0.10% or less in total, one or more of Mo, Cr, Cu, and Ni: 0.005% or more and 0.5% or less in total, and B: 0.0003% or more and 0.005% or less.

[3] The high-strength galvanized steel sheet according to [1] or [2], in which the chemical composition further contains, in mass %, at least one of Sb: 0.001% or more and 0.1% or less and Sn: 0.001% or more and 0.1% or less.

[4] The high-strength galvanized steel sheet according to any one of [1] to [3], in which the chemical composition further contains, in mass %, Ca: 0.0010% or less.

[5] A high strength member, obtained by subjecting the high-strength galvanized steel sheet according to any one of [1] to [4] to at least either one of forming and welding.

[6] A method for manufacturing a high-strength galvanized steel sheet including:

an annealing step of heating a cold rolled steel sheet having the chemical composition according to any one of [1] to [4] in an atmosphere in the furnace with a hydrogen concentration of 1 vol % or more and 13 vol % or less, in a temperature in the annealing furnace T1 of (an $A_{c3}$ point −10° C.) or more and 900° C. or less for 5 s or more, then performing cooling, and allowing the cold rolled steel sheet to retain in a temperature region of 400° C. or more and 550° C. or less for 20 s or more and 1500 s or less;

a coating step of subjecting a steel sheet after the annealing step to coating treatment, and performing cooling up to 100° C. or less at an average cooling rate of 3° C./s or more; and a post-heat treatment step of allowing a coated steel sheet after the coating step to retain in an atmosphere in the furnace with a hydrogen concentration of 10 vol % or less and a dew-point temperature of 50° C. or less, at a temperature T2 (° C.) of 70° C. or more and 450° C. or less for a time t (hr) that is 0.02 or more (hr) and satisfies a (2) formula or more.

$$135-17.2\times\ln(t)\leq T2 \quad (2)$$

[7] The method for manufacturing a high-strength galvanized steel sheet according to [6], including, before the annealing step, an pre-treatment step of heating the cold rolled steel sheet up to an $A_{c1}$ point or more and (the $A_{c3}$ point+50° C.) or less and performing pickling.

[8] The method for manufacturing a high-strength galvanized steel sheet according to [6] or [7], in which, after the coating step, temper rolling is performed at an extension rate of 0.1% or more.

[9] The method for manufacturing a high-strength galvanized steel sheet according to [8], in which width trimming is performed after the post-heat treatment step.

[10] The method for manufacturing a high-strength galvanized steel sheet according to [8], in which width trimming is performed before the post-heat treatment step, and a retaining time t (hr) for retaining at a temperature T2 (° C.) of 70° C. or more and 450° C. or less in the post-heat treatment step is 0.02 (hr) or more and satisfies a (3) formula below.

$$130-17.5\times\ln(t)\leq T2 \quad (3)$$

[11] A method for manufacturing a high strength member, including a step of performing at least either one of forming and welding on a high-strength galvanized steel sheet manufactured by the method for manufacturing a high-strength galvanized steel sheet according to any one of [6] to [10].

According to aspects of the present invention, a high-strength galvanized steel sheet and a high strength member that have high strength of a tensile strength of 1100 MPa or more and a yield ratio of 67% or more, are excellent in strength-ductility balance, are excellent also in hydrogen embrittlement resistance, and are also good in surface appearance quality (external appearance), and a method for manufacturing them can be provided.

BRIEF DESCRIPTION OF THE DRAWINGS

The FIGURE is a diagram showing an example of relationship between the amount of diffusible hydrogen and the smallest nugget diameter.

DETAILED DESCRIPTION OF EMBODIMENTS OF THE INVENTION

Hereafter, the embodiments of the present invention will be described. Here, the present invention is not limited to the embodiments described below.

<High-Strength Galvanized Steel Sheet>

A high-strength galvanized steel sheet according to aspects of the present invention includes a steel sheet and a galvanized layer formed on the steel sheet. In the following, a description is given for the steel sheet first and the galvanized layer next. The high strength referred to in accordance with aspects of the present invention means that tensile strength is 1100 MPa or more. Further, "excellent in strength-ductility balance" referred to in accordance with aspects of the present invention means that the relationship between the tensile strength TS (MPa), the elongation El (%), and the sheet thickness t (mm) satisfies the (1) formula below.

$$TS\times(El+3-2.5t)\geq 13000 \quad (1)$$

The chemical composition of the steel sheet is as follows. In the following description, "%" that is the unit of the content of a component means "mass %".

C: 0.10% or more and 0.30% or less

C is an effective element to increase the strength of the steel sheet, and contributes to strength increase by forming martensite, which is a hard phase of steel structure. To obtain these effects, the content of C is 0.10% or more, preferably 0.11% or more, and more preferably 0.12% or more. On the other hand, if the content of C is more than 0.30%, in accordance with aspects of the present invention, spot weldability is significantly degraded, and at the same time the steel sheet is hardened due to the strength increase of martensite and formability such as ductility tends to be reduced. Thus, the content of C is set to 0.30% or less. The content of C is preferably 0.28% or less, and more preferably 0.25% or less.

Si: 1.0% or more and 2.8% or less

Si is an element contributing to strength increase by solid solution strengthening, and is also an element that suppresses formation of carbides and effectively acts on the formation of retained austenite. From this point of view, the content of Si is set to 1.0% or more, and preferably 1.2% or more. On the other hand, Si is likely to form Si-based oxides on the surface of the steel sheet, and may be a cause of coating defect; furthermore, if Si is contained excessively, significant scales are formed during hot rolling and scale residual flaws are marked on the surface of the steel sheet; consequently, surface appearance quality may be deteriorated. Further, pickling ability may be reduced. From these points of view, the content of Si is set to 2.8% or less.

Mn: 2.0% or more and 3.5% or less

Mn is effective as an element contributing to strength increase by solid solution strengthening and martensite formation. To obtain this effect, the content of Mn needs to be 2.0% or more, preferably 2.1% or more, and more preferably 2.2% or more. On the other hand, if the content of Mn is more than 3.5%, spot weld cracking is likely to occur, and unevenness is likely to occur in the steel structure due to segregation or the like of Mn and formability decreases. Further, if the content of Mn is more than 3.5%, Mn is likely to concentrate as oxides or composite oxides on the surface of the steel sheet, and may be a cause of coating defect. Thus, the content of Mn is set to 3.5% or less. The content of Mn is preferably 3.3% or less, and more preferably 3.0% or less.

P: 0.010% or less

P is an element included unavoidably as well as an effective element contributing to the strength increase of the steel sheet by solid solution strengthening. If the content of P is more than 0.010%, formability such as weldability and stretch flangeability is reduced, and segregation in the grain boundary promotes the grain boundary embrittlement. Thus, the content of P is set to 0.010% or less. The content of P is preferably 0.008% or less, and more preferably 0.007% or less. The lower limit of the content of P is not particularly prescribed; however, if the content of P is less than 0.001%, a reduction in production efficiency and dephosphorization cost increase may be brought about in the manufacturing process. Thus, the content of P is preferably set to 0.001% or more.

S: 0.001% or less

S is also an element included unavoidably, same as P, is a harmful element that is a cause of hot brittleness, brings about a reduction in weldability, and reduces the formability of the steel sheet by existing as sulfide-based inclusions in the steel. Hence, the content of S is preferably reduced as much as possible. Thus, the content of S is set to 0.001% or less. The lower limit of the content of S is not particularly prescribed; however, if the content of S is less than 0.0001%, a reduction in production efficiency and cost increase may be brought about in the current manufacturing process. Hence, the content of S is preferably 0.0001% or more.

Al: 1% or less

Al is added as a deoxidizer. In the case where Al is added as a deoxidizer, it is preferable that 0.01% or more of Al be contained in order to obtain this effect. The content of Al is preferably 0.02% or more. On the other hand, contents of Al of more than 1% increase in source material cost, and are a cause of inducing surface defects of the steel sheet; thus, 1% is taken as the upper limit. The content of Al is preferably 0.4% or less, and more preferably 0.1% or less.

N: 0.0001% or more and 0.006% or less

If the content of N is more than 0.006%, excessive nitrides are produced in the steel and ductility and toughness are reduced, and the worsening of the surface appearance quality of the steel sheet may be caused. Hence, the content of N is set to 0.006% or less, preferably 0.005% or less, and more preferably 0.004% or less. Although the content is preferably as small as possible from the viewpoint of improving ductility by refining ferrite, such amounts reduce production efficiency and increase cost in the manufacturing process; thus, a lower limit of the content of N is set to 0.0001%. The content of N is preferably 0.0010% or more, and more preferably 0.0015% or more.

The chemical composition of the above-described steel sheet may contain, as arbitrary components, at least one of: one or more of Ti, Nb, V, and Zr: 0.005% or more and 0.10% or less in total; one or more of Mo, Cr, Cu, and Ni: 0.005% or more and 0.5% or less in total; and B: 0.0003% or more and 0.005% or less.

Ti, Nb, V, and Zr contribute to the strength increase of the steel sheet, especially high YR, by being formed as a fine precipitate that forms, together with C or N, a carbide or a nitride (there is also a case of a carbonitride). From the viewpoint of obtaining this effect, it is preferable that one or more of Ti, Nb, V, and Zr be contained at 0.005% or more in total. The total content is more preferably 0.015% or more, and still more preferably 0.030% or more. These elements are effective also for trap sites (rendering harmless) of hydrogen in steel. However, excessive contents of more than 0.10% in total increase deformation resistance during cold rolling and inhibit productivity; in addition, the presence of a excessive or coarse precipitate reduces the ductility of ferrite, and reduces formability such as ductility, bendability, and stretch flangeability of the steel sheet. Thus, the total amount mentioned above is preferably set to 0.10% or less. The total amount is more preferably 0.08% or less, and still more preferably 0.06% or less.

Mo, Cr, Cu, and Ni enhance hardenability and facilitate forming martensite, and are therefore elements contributing to strength increase. Thus, it is preferable that one or more of Mo, Cr, Cu, and Ni be contained at 0.005% or more in total. The total content is more preferably 0.010% or more, and still more preferably 0.050% or more. Further, for Mo, Cr, Cu, and Ni, excessive containing of a total content of more than 0.5% leads to the saturation of the effect and cost increase; thus, the total content is preferably set to 0.5% or less. For Cu, it induces cracking during hot rolling, and is a cause of the occurrence of surface flaws; thus, the upper limit of the content of Cu is preferably set to 0.5% or less. Ni has an effect of hindering the occurrence of surface flaws due to containing Cu, and is therefore preferably contained in a simultaneous manner when Cu is contained. In particular, the content amount of Ni is preferably ½ or more of the content of Cu.

B enhances hardenability and facilitates the formation of martensite, and is therefore an element contributing to strength increase. The content of B is preferably 0.0003% or more, more preferably 0.0005% or more, and still more preferably 0.0010% or more. The content of B has preferably the lower limit mentioned above set for obtaining the effect of suppressing ferrite formation occurring during an annealing cooling process. Further, even if the content of B includes more than 0.005%, the effect is saturated, and thus it is preferable to set the upper limit described above. Excessive hardenability has also a disadvantage such as weld cracking during welding.

The chemical composition of the above-described steel sheet may contain, as arbitrary components, at least one of Sb: 0.001% or more and 0.1% or less, or Sn: 0.001% or more and 0.1% or less.

Sb and Sn suppress decarburization, denitrification, deboronization, etc., and are elements effective to suppress the strength reduction of the steel sheet. These elements are effective also to suppress spot welding cracking; thus, each of the content of Sn and the content of Sb is preferably 0.001% or more. Each of the content of Sn and the content of Sb is more preferably 0.003% or more, and still more preferably 0.005% or more. However, for both Sn and Sb, excessive contents of more than 0.1% reduce formability such as stretch flangeability of the steel sheet. Thus, each of the content of Sn and the content of Sb is preferably set to 0.1% or less. Each of the content of Sn and the content of Sb is more preferably 0.030% or less, and still more preferably 0.010% or less.

The chemical composition of the steel sheet mentioned above may contain, as an optional component, Ca: 0.0010% or less.

Ca forms a sulfide or an oxide in the steel, and reduces the formability of the steel sheet. Hence, the content of Ca is preferably 0.0010% or less. The content of Ca is more preferably 0.0005% or less, and still more preferably 0.0003% or less. The lower limit is not particularly limited; however, in terms of manufacturing, it may be difficult to contain no Ca; thus, in view of this, the content of Ca is preferably 0.00001% or more. The content of Ca is preferably 0.00005% or more.

In the chemical composition of the steel sheet mentioned above, the balance other than the above is Fe and unavoidable impurities. For the optional components mentioned above, in the case where a component having a lower limit of its content is contained at a ratio less than the lower limit value mentioned above, the effect according to aspects of the present invention is not impaired, and hence the optional component is regarded as an unavoidable impurity.

Next, the steel structure of the steel sheet is described.

The steel structure contains, in terms of area ratio, 40% or more of martensite, 30% or less (including 0%) of ferrite, 4% or more and 20% or less of retained austenite, and 10% or more and 50% or less of bainite.

Area ratio of retained austenite is 4% or more and 20% or less

Austenite (retained austenite) observed at room temperature after the manufacturing of a steel sheet transforms to martensite due to induction by the stress of processing, etc., and is therefore likely to make strain propagation and improve the ductility of the steel sheet. This effect appears when the area ratio of retained austenite is 4% or more, and is significant when it is 5% or more. On the other hand, in austenite (an fcc phase), the diffusion of hydrogen in steel is slower and hydrogen is more likely to remain in the steel, and consequently hydrogen occluding ability is higher than in ferrite (a bcc phase); therefore, in the case where the retained austenite experiences strain-induced transformation, there is a concern that the amount of diffusible hydrogen in the steel will be increased. Thus, the area ratio of retained austenite is set to 20% or less. The area ratio of retained austenite is preferably 18% or less, and more preferably 15% or less.

Area ratio of ferrite is 30% or less (including 0%).

The presence of ferrite is not preferable from the viewpoint of obtaining high tensile strength and yield strength; however, in accordance with aspects of the present invention, the area ratio of ferrite is permitted up to 30% or less from the viewpoint of compatibility with ductility. The area ratio of ferrite is preferably 20% or less, and more preferably 15% or less. The lower limit of the area ratio of ferrite is not particularly limited, but the area ratio of ferrite is preferably 1% or more, more preferably 2% or more, and still more preferably 3% or more. Bainite which is formed at a comparatively high temperature and which does not contain carbides is regarded as ferrite without distinguishing such bainite from ferrite in the observation using a scanning electron microscope described in Examples below.

Area ratio of martensite being 40% or more

Here, martensite includes tempered martensite (including self-tempered martensite). As-quenched martensite and tempered martensite are hard phases, and are important in accordance with aspects of the present invention to obtain high tensile strength. Tempered martensite tends to soften as compared to as-quenched martensite. In order to ensure necessary strength, the area ratio of martensite is set to 40% or more, and preferably 45% or more. The upper limit of the area ratio of martensite is not particularly prescribed, but the area ratio of martensite is preferably 86% or less in view of balance with other structures. Further, from the viewpoint of ensuring ductility, the area ratio of martensite is more preferably 80% or less.

Area ratio of bainite being 10% or more and 50% or less

Bainite is harder than ferrite, and is effective to enhance the strength of the steel sheet. As mentioned above, in accordance with aspects of the present invention, bainite containing no carbide is regarded as ferrite; hence, the bainite herein refers to bainite containing carbide. On the other hand, bainite has ductility as compared to martensite, and the area ratio of bainite is set to 10% or more. However, in order to ensure necessary strength, the area ratio of bainite is set to 50% or less, and preferably 45% or less.

The steel structure occasionally contains a precipitate of pearlite, carbides, etc. in the balance, as a structure other than the structure mentioned above. These other structures (the balance other than ferrite, or retained austenite, martensite, and bainite) account for preferably 10% or less, and more preferably 5% or less, in terms of area ratio.

Results obtained by a method described in Examples are employed as the area ratios in the steel structure mentioned above. More specific method for measuring the area ratio is described in Examples, however, simple explanation is as follows. The area ratio mentioned above is found by a method in which a structure in a region of a position of ¼ (⅛ to ⅜) of the sheet thickness from the surface is taken as a representative. Further, the area ratio mentioned above is found by a method in which an L-cross section (a sheet-thickness cross section parallel to the rolling direction) of the steel sheet is polished, then corrosion is performed with a nital solution, 3 or more fields of view are observed by SEM with a magnification of 1500 times, and the photographed images are analyzed.

Next, the galvanized layer is described.

The composition of the galvanized layer is not particularly limited, and may be a common composition. For example, in the case of a hot-dip galvanized layer or an alloyed hot-dip galvanized layer, it is preferable that the composition be generally a composition containing Fe: 20 mass % or less and Al: 0.001 mass % or more and 1.0 mass % or less, further containing one or two or more selected from Pb, Sb, Si Sn, Mg, Mn, Ni, Cr, Co, Ca, Cu, Li, Ti, Be, Bi, and REMs at 0 mass % or more and 3.5 mass % or less in total, and containing the balance containing Zn and incidental impurities. In accordance with aspects of the present invention, it is preferable to have a hot-dip galvanized layer in which the coating weight per one surface is 20 to 80 g/m$^2$ or a galvannealed layer in which the hot-dip galvanized layer is further alloyed. In the case where the coating layer is a hot-dip galvanized layer, the content of Fe in the coating layer is preferably less than 7 mass %; in the case where the coating layer is a galvannealed layer, the content of Fe in the coating layer is preferably 7 to 20 mass %.

In the high-strength galvanized steel sheet according to aspects of the present invention, the amount of diffusible hydrogen in the steel obtained by measurement by a method described in Examples is less than 0.20 mass ppm. Diffusible hydrogen in the steel degrades hydrogen embrittlement resistance of the material. If the amount of diffusible hydrogen in the steel is 0.20 mass ppm or more, cracking of a weld nugget is likely to occur during welding, for example. In accordance with aspects of the present invention, it has been revealed that an improvement effect is provided by setting the amount of diffusible hydrogen in the steel to less than 0.20 mass ppm. The amount of diffusible hydrogen is preferably 0.15 mass ppm or less, more preferably 0.10 mass ppm or less, and still more preferably 0.08 mass ppm or less. The lower limit is not particularly limited, but is preferably as small as possible; thus, the lower limit is 0 mass ppm. In accordance with aspects of the present invention, it is necessary that, before subjecting the steel sheet to forming or welding, diffusible hydrogen in the steel account for less than 0.20 mass ppm. Note that, if the amount of diffusible hydrogen in the steel measured by using a sample cut out from a product (a member) that is obtained after subjecting the steel sheet to forming or welding and that is placed in a common usage environment is less than 0.20 mass ppm, the amount of diffusible hydrogen in the steel can be regarded as having been less than 0.20 mass ppm also before the forming or the welding.

The high-strength galvanized steel sheet according to aspects of the present invention has a sufficient strength. Specifically, the strength is 1100 MPa or more. The high-strength galvanized steel sheet according to aspects of the present invention has a high yield ratio. Specifically, the yield ratio (YR) is 67% or more. In the high-strength galvanized steel sheet according to aspects of the present invention, the balance between the tensile strength (TS) and the elongation (El) is adjusted in view of the sheet thickness (t). Specifically, the balance is adjusted so as to satisfy the (1) formula below. In Formula (1), the unit of the tensile strength TS is MPa, the unit of the elongation El is %, and the unit of the sheet thickness t is mm. The mechanical properties being thus adjusted is important in terms of solving the issue according to aspects of the present invention. The sheet thickness is usually preferably 0.3 mm or more and 3.0 mm or less.

$$TS\times(El+3-2.5t)\geq 13000 \quad (1)$$

<Method for Manufacturing High-Strength Galvanized Steel Sheet>

A method for manufacturing the high-strength galvanized steel sheet according to aspects of the present invention includes an annealing step, a coating step, and a post-heat treatment step. The temperatures at the time of heating or cooling slabs (steel raw materials), steel sheets, etc. shown below mean, unless otherwise stated, the surface temperatures of the slabs (the steel raw materials), the steel sheets, etc.

The annealing step is a step for heating a cold rolled steel sheet having the chemical composition described above in an atmosphere in the furnace with a hydrogen concentration of 1 vol % or more and 13 vol % or less, in a temperature region of a temperature in the annealing furnace T1 of (an $A_{c3}$ point −10° C.) or more and 900° C. or less for 5 s or more, then performing cooling, and allowing the cold rolled steel sheet to retain in a temperature region of 400° C. or more and 550° C. or less for 20 s or more and 1500 s or less.

First, a method for manufacturing a cold rolled steel sheet is described below.

A cold rolled steel sheet used in the manufacturing method according to an embodiment of the present invention is manufactured from a steel raw material. The steel raw material is generally called as a slab (cast piece) which is manufactured by using a continuous casting method. A continuous casting method is used in order to prevent the macro segregation of alloy constituent chemical elements. Steel may be manufactured by using, for example, an ingot casting or a thin-slab casting method.

In addition, after a steel slab has been manufactured, hot rolling may be performed by using any one of a conventional method in which the slab is reheated after having been cooled to room temperature, a method in which hot rolling is performed after the slab has been charged into a heating furnace in the warm state without having been cooled to near-room temperature, a method in which hot rolling is performed immediately after the slab has been subjected to heat retention for a short time, and a method in which hot rolling is performed directly on a cast piece in the hot state.

Although there is no particular limitation on the conditions used for hot rolling, it is preferable that steel having the chemical composition described above be heated to a temperature of 1100° C. or more and 1350° C. or less, subjected to hot rolling with a finish rolling delivery temperature of 800° C. or more and 950° C. or less, and coiled at a temperature of 450° C. or more and 700° C. or less. In the description below, those preferable conditions is explained.

It is preferable that the steel slab heating temperature be 1100° C. or more and 1350° C. or less. The grain diameter of precipitates in the steel slab tends to increase in the case where the slab-heating temperature is higher than the upper limit described above, and there may be a disadvantage in that it is difficult, for example, to achieve satisfactory strength through precipitation strengthening. In addition, there may be a case where precipitates having a large grain diameter have negative effects on the formation of a microstructure in the subsequent heat treatment. Further, coarsening of austenite grains may occur, also steel structure may be coarsened, and reduction in the strength and the elongation of the steel sheet may be caused. On the other hand, achieving a smooth steel sheet surface by appropriately performing heating in order to remove, for example, blowholes and defects from the surface of the slab through scale off so that there is a decrease in the number of cracks and in the degree of unevenness on the surface of a steel sheet is advantageous. In order to obtain such an effect, the heating temperature of the steel slab is preferably set to 1100° C. or more.

The heated steel slab is subjected to hot rolling including rough rolling and finish rolling. Generally, a steel slab is made into a sheet bar by performing rough rolling, and the sheet bar is made into a hot-rolled coil by performing finish rolling. In addition, there is no problem in the case where rolling is performed regardless of such a classification depending on, for example, rolling mill capacity as long as a predetermined size is obtained. It is preferable that hot rolling be performed under the conditions described below.

Finish rolling delivery temperature: 800° C. or more and 950° C. or less is preferable. By controlling the finish rolling delivery temperature to be 800° C. or more, there is a tendency for the steel structure of a hot-rolled coil to be uniform. Controlling the steel structure at this stage to be uniform allows the steel structure of an end product to be uniform. If the steel structure is non-uniform, formability such as elongation and the same tends to be reduced. On the other hand, in the case where the finish rolling delivery temperature is more than 950° C., since there is an increase in the amount of oxides (scale) formed, there is an increase in the degree of roughness of an interface between the base steel and the oxides, which may result in a deterioration in the surface appearance quality after pickling and cold rolling has been performed.

In addition, there is an increase in the crystal grain diameter of a steel structure, which may result in deterioration in the strength and formability such as bendability and elongation of a steel sheet as in the case of a steel slab. After hot rolling has been performed as described above, for the purpose of obtaining a fine and uniform steel structure, it is preferable that cooling be started within 3 seconds after finish rolling has been performed and that cooling be performed at an average cooling rate of 10 to 250° C./s in a temperature region from [finish rolling delivery temperature] to [finish rolling delivery temperature −100]° C. The average cooling rate is calculated by dividing the temperature difference (° C.) between [the finish rolling delivery temperature] and [the finish rolling delivery temperature −100° C.] by the time taken for cooling from [the finish rolling delivery temperature] to [the finish rolling delivery temperature −100° C.]

The coiling temperature is preferably set to 450° C. or more and 700° C. or less. Setting the temperature immediately before coiling after hot rolling, that is, the coiling temperature to 450° C. or more is preferable from the viewpoint of fine precipitation of a carbide when Nb or the like is added, and setting the coiling temperature to 700° C. or less is preferable because a cementite precipitate does not become too coarse. If the coiling temperature is in a temperature region of 450° C. or less or 700° C. or more, the structure is likely to change during holding after coiling, and rolling trouble etc. due to the non-uniformity of the steel structure of the material are likely to occur in cold rolling of a later step. From the viewpoints of grain size adjustment of the hot rolled sheet structure etc., the coiling temperature is more preferably set to 500° C. or more and 680° C. or less.

Subsequently, cold rolling step is performed. Here, the hot-rolled steel sheet is usually made into a cold-rolled coil by performing cold rolling following pickling for the purpose of descaling. Such pickling is performed as needed.

It is preferable that cold rolling be performed with a rolling reduction ratio of 20% or more. This is for the purpose of forming a uniform and fine steel structure in the subsequent heating process. In the case where the rolling reduction ratio is less than 20%, since there may be a case where a microstructure having a large grain diameter or a non-uniform microstructure is formed when heating is performed, there is a risk of a deterioration in the strength and formability of an end product sheet after the subsequent heat treatment has been performed as described above, and the surface appearance quality may also be deteriorated. Although there is no particular limitation on the upper limit of the rolling reduction ratio, there may be a case of deterioration in productivity due to a high rolling load and deterioration in shape in the case where a high-strength steel sheet is subjected to cold rolling with a high rolling reduction ratio. It is preferable that rolling reduction ratio be 90% or less.

The annealing step is a step for heating, the cold rolled steel sheet described above, the cold rolled steel sheet having the chemical composition described above in an atmosphere in the furnace with a hydrogen concentration of 1 vol % or more and 13 vol % or less, in a temperature region of a temperature in the annealing furnace T1 of (an $A_{c3}$ point −10° C.) or more and 900° C. or less for 5 s or more, then performing cooling, and allowing the cold rolled steel sheet to retain in a temperature region of 400° C. or more and 550° C. or less for 20 s or more and 1500 s.

The average heating rate for bringing the temperature in the annealing furnace T1 within the temperature region of (the $A_{c3}$ point −10° C.) or more and 900° C. or less is not particularly limited, but the average heating rate is preferably less than 10° C./s for the reason of obtaining uniform steel structure. Further, the average heating rate is preferably 1° C./s or more from the viewpoint of suppressing the reduction in manufacturing efficiency.

The temperature in the annealing furnace T1 is set to (the $A_{c3}$ point −10° C.) or more and 900° C. or less in order to ensure both material quality and coatability. If the temperature in the annealing furnace T1 is less than (the $A_{c3}$ point −10° C.), the finally obtained steel structure has a high area ratio of ferrite, and an amount of retained austenite, martensite, or bainite necessary to obtain are difficult to form. In addition, it is not preferable that the temperature in the annealing furnace T1 be more than 900° C., because this results in deterioration in formability such as elongation due to increased crystal grain diameter. In addition, in the case where the temperature in the annealing furnace T1 is more than 900° C., since Mn and Si tend to be concentrated in the surface layer, there is deterioration in coatability. In addition, in the case where the temperature in the annealing furnace T1 is more than 900° C., since a load placed on the equipment is stably high, there may be a case where manufacturing is not possible.

In the manufacturing method according to aspects of the present invention, heating is performed at the temperature of the temperature in the annealing furnace T1 of (the $A_{c3}$ point −10° C.) or more and 900° C. or less for 5 s or more. The heating time is preferably 600 seconds or less for the reason of preventing the excessive coarsening of austenite grain diameters.

The hydrogen concentration in the temperature region of (the $A_{c3}$ point −10° C.) or more and 900° C. or less is set to 1 vol % or more and 13 vol % or less. In accordance with aspects of the present invention, not only the temperature in the annealing furnace T1 described above but also the atmosphere in the furnace is simultaneously controlled; thereby, coatability is ensured, and at the same time the entry of excessive hydrogen into the steel is prevented. If the hydrogen concentration is less than 1 vol %, coating defect often occurs. At hydrogen concentrations more than 13 vol %, the effect for coatability is saturated, and at the same time the entry of hydrogen into the steel is considerably increased and hydrogen embrittlement resistance of the final product are degraded. Outside the temperature region of (the $A_{c3}$ point −10° C.) or more and 900° C. or less mentioned above, the hydrogen concentration may not be in the range of 1 vol % or more.

When performing cooling after retaining in the hydrogen concentration atmosphere mentioned above, the steel sheet is allowed to retain in the temperature region of 400° C. or more and 550° C. or less for 20 s or more. This is in order to make it easy to form bainite and obtain retained austenite. The retaining has also the effect of hydrogen in the steel being removed. In order to form desired amounts of bainite and retained austenite, it is necessary to retain the steel sheet in this temperature region for 20 s or more. The upper limit of the retaining time is set to 1500 s or less from the viewpoints of manufacturing cost, etc. Retaining at less than 400° C. is not preferable because the temperature is likely to be below the coating bath temperature subsequently used and the quality of the coating bath is reduced, however, in this case, the sheet temperature may be increased to the coating bath temperature by heating; thus, the lower limit of the temperature region mentioned above is set to 400° C. On the other hand, in the temperature region of more than 550° C., not bainite but ferrite and pearlite are likely to be formed, and retained austenite is less likely to be obtained. It is preferable that a cooling be performed at a cooling rate (average cooling rate) of 3° C./s or more from the temperature in the annealing furnace T1 to this temperature region. This is because, since ferrite or pearlite transformation tends to occur in the case where the cooling rate is less than 3° C./s, there may be a case where to form the desired steel structure is not possible. There is no particular limitation on the upper limit of the preferable cooling rate. Although the cooling may be stopped in the above-described temperature region of 400 to 550° C., the steel sheet may be held in a temperature region of 400 to 550° C. after having been subjected to cooling to a temperature which is the temperature region or less followed by reheating. In this case, there may be a case where martensite is formed and then tempered if cooling is performed to a temperature which is the Ms point or less.

In a coating step, coating treatment is performed for a steel sheet after the annealing step, and cooling up to 100° C. or less at an average cooling rate of 3° C./s or more is performed.

The method of coating treatment is preferably hot-dip galvanization treatment. The conditions may be set as appropriate. Alloying treatment may be performed as necessary; when performing alloying, alloying (galvannealing) is performed by heating after hot-dip galvanization is performed. For the temperature at the time of alloying treatment, a treatment of performing holding in the temperature region of 480° C. or more and 600° C. or less for approximately 1 second (s) or more and 60 seconds or less may be given as an example. If the treatment temperature is more than 600° C., retained austenite is less likely to be obtained; thus, it is preferable to perform treatment at 600° C. or less.

After the coating treatment (or after the alloying treatment when performing alloying), cooling is performed down to 100° C. or less at an average cooling rate of 3° C./s or more. This is in order to obtain martensite essential for strength increase. The average cooling rate is calculated by dividing the temperature difference between the cooling start temperature after coating treatment and 100° C. by the time taken for cooling from the cooling start temperature to 100° C. When the cooling rate is less than 3° C./s, it is difficult to obtain martensite necessary for strength, and stopping cooling at a temperature higher than 100° C. leads to a situation where martensite is excessively tempered (self-tempered) at this time point and austenite does not become martensite but transforms to ferrite, and necessary strength is difficult to obtain. The upper limit of the average cooling rate is not particularly prescribed, but is preferably set to 200° C./s or less. This is because, if the average cooling rate is set to 200° C./s or more, the burden of facility investment is large. It is also possible to perform cooling immediately after coating treatment.

After the coating step, a post-heat treatment step is performed. The post-heat treatment step is a step for allowing a coated steel sheet after the coating step to retain in an atmosphere in the furnace with a hydrogen concentration of 10 vol % or less and a dew-point temperature Dp of 50° C. or less, at a temperature T2 (° C.) of 70° C. or more and 450° C. or less for a time t (hr) that is 0.02 or more (hr) and satisfies a (2) formula or more.

$$135-17.2\times\ln(t)\leq T2 \quad (2)$$

The post-heat treatment step is performed in order to reduce the amount of diffusible hydrogen in the steel. The increase in the amount of diffusible hydrogen in the steel can be suppressed by making an atmosphere in the furnace with a hydrogen concentration to 10 vol % or less and a dew-point temperature Dp of 50° C. or less. The hydrogen concentration is preferably smaller, and is preferably 5 vol % or less, more preferably 2 vol % or less. The lower limit of the hydrogen concentration is not particularly limited, and is preferably smaller as mentioned above, therefore, a preferred lower limit is 1 vol %. Further, to obtain the effects mentioned above, the dew-point temperature Dp is 50° C. or less, preferably 45° C. or less, and more preferably 40° C. or less. The lower limit of the dew-point temperature is not particularly limited, but is preferably −80° C. or more from the viewpoint of manufacturing cost.

If the temperature T2 for retaining is a temperature more than 450° C., a reduction in ductility due to destruction of retained austenite, a reduction in tensile strength, the degradation of the coating layer, and the degradation of the external appearance occur; thus, the upper limit of the temperature T2 is set to 450° C. The upper limit is preferably 430° C. or less, and more preferably 420° C. or less. Further, if the lower limit of the temperature T2 for retaining is less than 70° C., it is difficult to sufficiently reduce the amount of diffusible hydrogen in the steel, and cracking occurs in a weld. Thus, the lower limit of the temperature T2 mentioned above is set to 70° C. The lower limit is preferably 80° C. or more, and more preferably 90° C. or more.

To reduce the amount of hydrogen in the steel, it is important to make not only the temperature but also the time appropriate. By adjusting the time for retaining such that it is 0.02 hr or more and satisfies the (2) formula above, the amount of diffusible hydrogen in the steel can be reduced.

After the cold rolling mentioned above and before annealing step, a pre-treatment step in which the cold rolled sheet obtained by cold rolling is heated in the temperature region of the $A_{c1}$ point or more and ($A_{c3}$ point +50° C.) or less and pickling is performed may be performed.

Heating to a temperature region of the $A_{c1}$ point or more and (the $A_{c3}$ point +50° C.) or less "Heating to a temperature region of the $A_{c1}$ point or more and (the $A_{c3}$ point+50° C.) or less" is the condition for achieving high ductility and satisfactory coatability by forming the steel structure in an end product. It is preferable that a microstructure including martensite be formed before the subsequent annealing step from the viewpoint of material properties. Moreover, it is also preferable that the oxides of, for example, Mn be concentrated in the surface layer of a steel sheet through this heating process from the viewpoint of coatability. From such points of view, it is preferable that heating be performed to a temperature region of the $A_{c1}$ point or more and (the $A_{c3}$ point +50° C.) or less. Here, regarding the $A_{c1}$ and $A_{c3}$ described above, values obtained in the following equations are used. Here, $$A_{c1}=751-27C+18Si-12Mn-23Cu-23Ni+24Cr+23Mo-40V-6Ti+32Zr+233Nb-169Al-895B$$

$$A_{c3}=910-203(C)^{1/2}+44.7Si-30\ Mn-11P+700S+400Al+400Ti$$

The atomic symbols in the equations above respectively denote the contents (mass %) of the corresponding chemical elements, and where the symbol of a chemical element which is not contained is assigned a value of 0.

In the above pickling after heating, in order to achieve satisfactory coatability in the subsequent annealing step, the oxides of, for example, Si and Mn, which have been concentrated in the surface layer of the steel sheet, are removed by performing pickling. In the case where the pre-treatment step is performed, it is necessary to perform pickling.

Further, temper rolling may be performed after the coating step.

Temper rolling is preferably performed at an extension rate of 0.1% or more after the cooling of the coating step. Temper rolling may not be performed. In the case where temper rolling is performed, it is preferable to be performed on the coated steel sheet with an extension rate of 0.1% or more for the purpose of stably achieving an YS in addition to correcting the shape and controlling the surface roughness. Leveler processing may be performed instead of temper rolling for the purpose of correcting the shape and controlling the surface roughness. In the case where excessive temper rolling is performed, since excessive strain is introduced to the surface of a steel sheet, there is a decrease in the evaluation values of ductility and stretch flangeability. In addition, in the case where excessive temper rolling is performed, there is deterioration in ductility, and there is an increase in load placed on the equipment due to the high strength of the steel sheet. Therefore, it is preferable that temper rolling be performed with a rolling reduction ratio of 3% or less.

It is preferable to perform width trimming before or after the temper rolling mentioned above. Coil width adjustment can be performed by the width trimming. Further, by performing width trimming before the post-heat treatment step as mentioned below, hydrogen in steel can be released efficiently in the post-heat treatment subsequently performed.

In a case where width trimming is performed, it is preferable to be performed before the post-heat treatment step. In a case where width trimming is performed before the post-heat treatment step, a retaining time t (hr) for retaining at a temperature T2 (° C.) of 70° C. or more and 450° C. or less in the post-heat treatment step may be 0.02 or more (hr) and satisfy a (3) formula below.

$$130-17.5\times\ln(t)\leq T2 \quad (3)$$

As is clear from the (3) formula, as compared to the case of the (2) formula above, the time can be shortened when the temperature condition is the same, and the temperature can be lowered when the condition of the retaining time is the same.

<High Strength Member and Method for Manufacturing Same>

A high strength member according to aspects of the present invention is a member obtained by subjecting a high-strength galvanized steel sheet according to aspects of the present invention to at least either one of forming and welding. A method for manufacturing a high strength member according to aspects of the present invention includes a step of performing at least either one of forming and welding on a high-strength galvanized steel sheet manufactured by a method for manufacturing a high-strength galvanized steel sheet according to aspects of the present invention.

The high strength member according to aspects of the present invention has high strength of a tensile strength of 1100 MPa or more and a yield ratio of 67% or more, is excellent in strength-ductility balance, is excellent also in hydrogen embrittlement resistance, and is also excellent in surface appearance quality (external appearance). Thus, the high strength member according to aspects of the present invention can be suitably used for, for example, automotive parts.

As the forming, general processing methods such as press forming may be used without limitations. As the welding, usual welding such as spot welding or arc welding may be used without limitations.

EXAMPLES

Example 1

Molten steel of the chemical composition of steel number A shown in Table 1 was smelted with a converter, and was made into a slab by a continuous casting machine. The slab was heated to 1200° C., and was made into a hot rolled coil under the conditions of a finish rolling temperature of 840° C. and a coiling temperature of 550° C. The hot rolled coil was made into a cold rolled steel sheet with a sheet thickness of 1.4 mm under a cold rolling reduction ratio of 50%. The cold rolled steel sheet was heated up to 810° C. (in the range of (the $A_{c3}$ point −10° C.) or more and 900° C. or less) by annealing treatment in an atmosphere in the furnace with various hydrogen concentration and a dew-point temperature of −30° C., was allowed to retain for 60 seconds, was then cooled down to 500° C., and was allowed to retain for 100 seconds. After that, galvanization was performed and alloying treatment was performed; after the coating, the steel sheet was passed through a water tank at a water temperature of 40° C. to be cooled to the cooling stop temperature 100° C. or less, with the average cooling rate set to 3° C./s; thus, a high-strength galvanized steel sheet (a product sheet) was manufactured. Temper rolling was performed after the coating, with the extension rate set to 0.2%. Width trimming was not performed.

Samples were cut out from each sheet, and were subjected to the analysis of hydrogen amount in the steel and the evaluation of nugget cracking of welds as the evaluation of hydrogen embrittlement resistance. The results are shown in the figure.

Amount of Hydrogen in Steel

The amount of hydrogen in the steel was measured by the following method. First, an approximately 5×30-mm test piece was cut out from the galvanized steel sheet subjected to up to the post-heat treatment. Next, a router (precision grinder) was used to remove the coating on a surface of the test piece, and the test piece was put into a quartz tube. Next, the interior of the quartz tube was substituted with Ar, then the temperature was increased at 200° C./hr, and hydrogen generated until reaching 400° C. was analyzed by a gas chromatograph. In this way, the amount of hydrogen released was measured by the programmed temperature analysis method. The cumulative value of the amount of hydrogen detected in the temperature region of room temperature (25° C.) to less than 250° C. was taken as the amount of diffusible hydrogen.

Hydrogen Embrittlement Resistance (Welding Cracking)

Nugget cracking of resistance spot welds of steel sheets was evaluated as the evaluation of hydrogen embrittlement resistance. In the evaluation method, sheets each with a sheet thickness of 2 mm were placed as spacers individually between both ends of 30×100 mm sheets, and the centers between the spacers were joined together by spot welding; thus, a test piece as a member was fabricated. At this time, for the spot welding, an inverter DC resistance spot welding machine was used, and a dome-form electrode made of chromium-copper and having a tip diameter of 6 mm was used as the electrode. The welding pressure was set to 380 kgf, the welding time to 16 cycles/50 Hz, and the holding time to 5 cycles/50 Hz. The welding current value was changed, and samples with various nugget diameters were produced.

The spacing between the spacers at both ends was set to 40 mm, and the steel sheets and the spacers were lashed by welding in advance. After the welding, the test piece was allowed to stand for 24 hours, then the spacer portions were cut off and the cross-sectional observation of the weld nuggets was performed to evaluate the presence or absence of cracks due to hydrogen embrittlement, and the smallest nugget diameter out of the nugget diameters having no crack was found. The figure shows a relationship between the amount of diffusible hydrogen (mass ppm) and the smallest nugget diameter (mm).

As shown in the figure, when the amount of diffusible hydrogen in the steel is more than 0.20 mass ppm, the smallest nugget diameter increases rapidly, and the smallest nugget diameter is more than 4 mm and degrades.

In the case where the amount of diffusible hydrogen is in the range of the present according to aspects invention, also the steel structure and the mechanical properties are in the ranges according to aspects of the present invention.

TABLE 1

| | Chemical composition (mass %) | | | | | | | | $A_{C1}$ | $A_{C3}$ | |
|---|---|---|---|---|---|---|---|---|---|---|---|
| Steel No. | C | Si | Mn | P | S | N | Al | Others | (° C.) | (° C.) | Remarks |
| A | 0.130 | 1.25 | 2.67 | 0.008 | 0.0008 | 0.0038 | 0.030 | Ti: 0.018, Nb: 0.018<br>B: 0.0012, Sb: 0.0120<br>Sn: 0.0021, Ca: 0.0003 | 736 | 832 | Invented example |
| B | 0.085 | 1.18 | 2.13 | 0.008 | 0.0009 | 0.0041 | 0.035 | | 738 | 854 | Comparative example |
| C | 0.320 | 1.62 | 2.45 | 0.008 | 0.0007 | 0.0039 | 0.038 | | 736 | 810 | Comparative example |
| D | 0.106 | 1.98 | 2.33 | 0.009 | 0.0008 | 0.0025 | 0.041 | Cr: 0.34, Ca: 0.0004 | 757 | 879 | Invented example |
| E | 0.282 | 1.15 | 2.02 | 0.007 | 0.0008 | 0.0038 | 0.043 | Sb: 0.0050, Zr: 0.010 | 733 | 811 | Invented example |
| F | 0.144 | 1.41 | 3.26 | 0.007 | 0.0007 | 0.0037 | 0.034 | | 728 | 812 | Invented example |
| G | 0.120 | 0.93 | 2.76 | 0.007 | 0.0008 | 0.0027 | 0.035 | | 725 | 813 | Comparative example |
| H | 0.144 | 1.42 | 1.86 | 0.008 | 0.0009 | 0.0045 | 0.043 | | 743 | 858 | Comparative example |
| I | 0.146 | 1.55 | 3.71 | 0.007 | 0.0007 | 0.0032 | 0.033 | | 725 | 804 | Comparative example |
| J | 0.151 | 1.36 | 2.54 | 0.046 | 0.0008 | 0.0034 | 0.032 | | 736 | 829 | Comparative example |
| K | 0.143 | 1.44 | 2.61 | 0.009 | 0.0038 | 0.0031 | 0.044 | | 734 | 839 | Comparative example |
| L | 0.182 | 1.26 | 2.20 | 0.006 | 0.0006 | 0.0056 | 0.062 | V: 0.023 | 731 | 839 | Invented example |
| M | 0.115 | 1.38 | 2.88 | 0.007 | 0.0008 | 0.0029 | 0.033 | Mo: 0.15 | 736 | 830 | Invented example |
| N | 0.134 | 1.53 | 2.55 | 0.007 | 0.0008 | 0.0041 | 0.051 | Cu: 0.21, Ni: 0.12<br>Sn: 0.005 | 728 | 848 | Invented example |

Example 2

Molten steel of each of the chemical compositions of steel numbers A to N shown in Table 1 was smelted with a converter, and was made into a slab with a continuous casting machine; then, the slab was heated to 1200° C., and was then hot rolled into a hot rolled coil under the conditions of a finish rolling delivery temperature of 910° C. and a coiling temperature of 560° C. After that, a cold rolled coil with a sheet thickness of 1.4 mm was obtained at a cold rolling reduction ratio of 50%. Respecting this, heating (annealing), pickling (a pickling liquid in which the HCl concentration was adjusted to 5 mass % and the liquid temperature to 60° C. was used), coating treatment, temper rolling, width trimming, and a post-heat treatment were performed under the various conditions shown in Table 2; thus, high-strength galvanized steel sheets (product sheets)

each with a thickness of 1.4 mm were manufactured. The cooling (cooling after coating treatment) was performed to 100° C. or less by passing the steel sheet through a water tank at a water temperature of 50° C. Further, in the coating treatment, galvannealing (alloying) treatment of galvanization was performed under conditions of 530° C. and 20 seconds.

By taking samples from the galvanized steel sheets obtained as described above, and by performing steel structure observation and a tensile test through the use of the methods described below, phase fraction (area ratio) of a structure, yield strength (YS), tensile strength (TS), and yield ratio (YR=YS/TS) were determined or calculated. Further, the external appearance was visually observed to evaluate coatability (surface appearance quality). The evaluation method is as follows. Nugget cracking of welds was evaluated as the evaluation of hydrogen embrittlement resistance.

Structure Observation

By taking a sample for structure observation from the hot-dip galvanized steel sheet, by polishing an L-cross section (thickness cross section parallel to the rolling direction), by etching the polished cross section through the use of a nital solution, by performing observation through the use of a SEM at a magnification of 1500 times in 3 or more fields of view in the vicinity of a position located ¼t (t denotes a whole thickness) from the surface in the etched cross section in order to obtain image data, and by performing image analysis on the obtained image data, area ratio was determined for each of the observed fields of view, and average value of the determined area ratios was calculated. However, the volume ratio of retained austenite (the volume ratio is regarded as the area ratio) was quantified by the intensity of X-ray diffraction; therefore, there is a case of a result in which the sum total of the structures is more than 100%. F of Table 3 stands for ferrite, M for martensite, B for bainite, and Residual γ for retained austenite.

In the structure observation mentioned above, pearlite and aggregations of precipitates and inclusions were observed as other phases in some examples.

Tensile Test

A tensile test was performed with a constant tensile speed (crosshead speed) of 10 mm/min on a JIS No. 5 tensile test piece (JIS Z 2201) taken from the tensile test galvanized steel sheet in a direction perpendicular to the rolling direction. The yield strength (YS) was defined as 0.2%-proof stress which was derived from the inclination in the elastic range corresponding to a stress of 150 to 350 MPa, and the tensile strength was defined as the maximum load in the tensile test divided by the initial cross-sectional area of the parallel part of the test piece. When the cross-sectional area of the parallel part was calculated, the thickness was defined as the thickness including that of the coating layer. The tensile strength (TS), the yield strength (YS), and the elongation (El) were measured, and the yield ratio YR and the (1) formula were calculated.

Hydrogen Embrittlement Resistance

Hydrogen embrittlement resistance characteristics of resistance spot welds of steel sheets were evaluated as the evaluation of hydrogen embrittlement resistance. The method of evaluation is similar to the one of the Example 1. As the welding current value, a condition whereby a nugget diameter according to the strength of each steel sheet was to be formed was used. A nugget diameter of 3.8 mm was employed for 1100 MPa or more and less than 1250 MPa, and a nugget diameter of 4.8 mm for 1250 MPa or more and 1400 MPa or less. Similar to Example 1, the spacing between the spacers at both ends was set to 40 mm, and the steel sheets and the spacers were lashed by welding in advance. After the welding, the test piece was allowed to stand for 24 hours, then the spacer portions were cut off and the cross-sectional observation of the weld nugget was performed to evaluate if there is cracking. In the column of welding cracking in the table 3, no crack being present is shown by "○", and a crack being present is shown by "×".

Surface Appearance Quality (External Appearance)

After a coating treatment, visual observation on the appearance was performed after a heat treatment had been performed, a case where no coating defect was observed was judged as "good", a case where coating defects were observed was judged as "failure", a case where no coating defect was observed but, for example, a variation in coating appearance was observed was judged as "slightly good". Here, the term "coating defects" denotes areas having a size of about several micrometers to several millimeters in which no coating layer exists so that the steel sheet is exposed.

The amount of Diffusible Hydrogen in the Steel

The measurement of the amount of diffusible hydrogen in the steel was performed by a similar method to Example 1.

The obtained results are shown in Table 3. Invention Examples were good in all of TS, YR, surface appearance quality, and hydrogen embrittlement resistance. Comparative Examples were poor in any of these. Further, from comparison between Invention Examples and Comparative Examples, it can be seen that the relationship between the amount of diffusible hydrogen and hydrogen embrittlement resistance is similar to the figure within the ranges of the chemical composition and the steel structure according to aspects of the present invention and that, when the amount of diffusible hydrogen is less than 0.20 mass ppm, the evaluation of resistance spot weld nugget cracking is good as hydrogen embrittlement resistance.

TABLE 2

| | | Pre-treatment step | | Annealing step | | | | | Coating | Temper |
|---|---|---|---|---|---|---|---|---|---|---|
| No. | Steel No. | Heating temperature (° C.) | Pickling Presence or absence | *1 (° C./s) | *2 T1 (° C.) | *3 (s) | Hydrogen concentration (vol %) | *4 (s) | step *5 (° C./s) | rolling Extension rate (%) |
| 1 | A | Absence | Absence | 3.5 | 830 | 30 | 8 | 100 | 5 | 0.15 |
| 2 | A | Absence | Absence | 3.5 | 830 | 30 | 8 | 100 | 5 | 0.15 |
| 3 | A | Absence | Absence | 3.5 | 830 | 30 | 8 | 100 | 5 | 0.15 |
| 4 | A | Absence | Absence | 3.5 | 760 | 60 | 8 | 100 | 5 | 0.15 |
| 5 | A | 800 | Presence | 3.5 | 830 | 30 | 8 | 100 | 5 | 0.15 |
| 6 | A | Absence | Absence | 3.5 | 830 | 30 | 18 | 100 | 5 | 0.15 |
| 7 | A | Absence | Absence | 3.5 | 830 | 30 | 8 | 100 | 5 | 0.15 |
| 8 | A | Absence | Absence | 3.5 | 830 | 30 | 8 | 100 | 5 | 0.15 |
| 9 | A | Absence | Absence | 3.5 | 850 | 30 | 8 | 40 | 8 | 0.15 |

TABLE 2-continued

| | | | | | | | | | | |
|---|---|---|---|---|---|---|---|---|---|---|
| 10 | B | Absence | Absence | 8.0 | 860 | 40 | 7 | 45 | 8 | 0.30 |
| 11 | C | Absence | Absence | 3.0 | 810 | 20 | 9 | 50 | 4 | 0.05 |
| 12 | D | Absence | Absence | 5.0 | 880 | 10 | 9 | 90 | 6 | 0.16 |
| 13 | E | Absence | Absence | 4.0 | 820 | 15 | 8 | 120 | 7 | 0.05 |
| 14 | F | Absence | Absence | 5.0 | 800 | 35 | 10 | 150 | 8 | 0.25 |
| 15 | F | 780 | Presence | 5.0 | 800 | 35 | 10 | 150 | 8 | 0.25 |
| 16 | F | Absence | Absence | 5.0 | 800 | 35 | 10 | 150 | 8 | 0.25 |
| 17 | F | Absence | Absence | 5.0 | 800 | 35 | 10 | 150 | 8 | 0.25 |
| 18 | G | Absence | Absence | 4.0 | 770 | 50 | 8 | 100 | 7 | 0.30 |
| 19 | H | Absence | Absence | 3.0 | 810 | 35 | 10 | 150 | 3 | 0.30 |
| 20 | I | Absence | Absence | 3.0 | 800 | 35 | 10 | 150 | 3 | 0.05 |
| 21 | J | Absence | Absence | 6.0 | 780 | 20 | 10 | 100 | 7 | 0.20 |
| 22 | K | Absence | Absence | 6.0 | 780 | 20 | 10 | 100 | 7 | 0.20 |
| 23 | L | Absence | Absence | 9.0 | 820 | 30 | 8 | 70 | 9 | 0.25 |
| 24 | M | Absence | Absence | 6.0 | 790 | 25 | 7 | 80 | 7 | 0.25 |
| 25 | N | Absence | Absence | 6.0 | 820 | 10 | 12 | 85 | 8 | 0.25 |

| | | Post-heat treatment step | | | | | |
|---|---|---|---|---|---|---|---|
| No. | Width trimming | Hydrogen concentration (vol %) | Dew-point temperature (° C.) | Retaining temperature T2 (° C.) | Time t (hr) | *6 | Remarks |
| 1 | — | 1 | 0 | 100 | 12 | 92 | Invented example |
| 2 | — | 1 | 0 | 50 | 24 | 80 | Comparative example |
| 3 | — | 1 | 0 | 470 | 10 | 95 | Comparative example |
| 4 | — | 1 | 0 | 80 | 32 | 75 | Comparative example |
| 5 | — | 1 | 0 | 100 | 12 | 92 | Invented example |
| 6 | — | 1 | 0 | 100 | 12 | 92 | Comparative example |
| 7 | *7 | 1 | 0 | 110 | 6 | 104 | Invented example |
| 8 | — | 1 | 0 | 200 | 12 | 92 | Invented example |
| 9 | — | 1 | 0 | 100 | 12 | 92 | Invented example |
| 10 | — | 0 | 0 | 150 | 40 | 72 | Comparative example |
| 11 | — | 0 | 0 | 400 | 1 | 135 | Comparative example |
| 12 | — | — | — | — | — | — | Invented example |
| 13 | — | 0 | 0 | 300 | 3 | 116 | Invented example |
| 14 | — | — | — | — | — | — | Invented example |
| 15 | — | — | — | — | — | — | Invented example |
| 16 | *8 | — | — | — | — | — | Invented example |
| 17 | *8 | 0 | 0 | 90 | 50 | 68 | Invented example |
| 18 | — | 0 | 0 | 120 | 30 | 76 | Comparative example |
| 19 | — | — | — | — | — | — | Comparative example |
| 20 | — | 0 | 0 | 200 | 6 | 104 | Comparative example |
| 21 | — | 0 | 0 | 75 | 120 | 53 | Comparative example |
| 22 | — | 0 | 0 | 75 | 120 | 53 | Comparative example |
| 23 | — | 0 | 0 | 70 | 150 | 49 | Invented example |
| 24 | — | 0 | 0 | 120 | 50 | 68 | Invented example |
| 25 | — | 0 | 0 | 140 | 48 | 68 | Invented example |

*1: An average heating rate for bringing the temperature in the annealing furnace T1 within the temperature region

*2: Temperature in the annealing furnace

*3: The heating time in the temperature in the annealing furnace T1

*4: The retaining time for temperature region of 400° C. or more and 550° C. or less

*5: An average cooling rate in cooling to 100° C. or less after the coating treatment

*6: $135 - 17.2 \times \ln(t)$

*7: Width trimming is performed before the post-heat treatment step.

*8: Width trimming is performed after the post-heat treatment step.

TABLE 3

| | | Area ratios of metal structure | | | | Product plate | |
|---|---|---|---|---|---|---|---|
| No. | Steel No. | F (%) | M (%) | B (%) | Retained γ (%) | TS (MPa) | YS (MPa) |
| 1 | A | 15 | 50 | 20 | 11 | 1195 | 830 |
| 2 | A | 15 | 50 | 20 | 11 | 1195 | 800 |
| 3 | A | 15 | 50 | 20 | 3 | 1160 | 890 |
| 4 | A | 55 | 20 | 20 | 4 | 985 | 640 |
| 5 | A | 10 | 50 | 25 | 13 | 1200 | 840 |
| 6 | A | 15 | 50 | 20 | 11 | 1195 | 830 |
| 7 | A | 15 | 50 | 20 | 11 | 1195 | 825 |
| 8 | A | 15 | 50 | 20 | 11 | 1195 | 850 |
| 9 | A | 10 | 70 | 15 | 5 | 1270 | 850 |
| 10 | B | 18 | 60 | 12 | 4 | 1080 | 735 |
| 11 | C | 2 | 75 | 14 | 9 | 1390 | 1015 |
| 12 | D | 15 | 65 | 10 | 10 | 1115 | 760 |
| 13 | E | 13 | 67 | 14 | 6 | 1395 | 1142 |

TABLE 3-continued

| | | | | | | | |
|---|---|---|---|---|---|---|---|
| 14 | F | 12 | 65 | 11 | 12 | 1286 | 860 |
| 15 | F | 10 | 65 | 14 | 11 | 1268 | 860 |
| 16 | F | 12 | 65 | 11 | 12 | 1286 | 860 |
| 17 | F | 12 | 65 | 11 | 12 | 1272 | 910 |
| 18 | G | 21 | 62 | 14 | 3 | 1150 | 864 |
| 19 | H | 25 | 48 | 18 | 9 | 1060 | 860 |
| 20 | I | 7 | 64 | 21 | 8 | 1384 | 1172 |
| 21 | J | 28 | 51 | 14 | 7 | 1241 | 842 |
| 22 | K | 26 | 52 | 14 | 8 | 1251 | 854 |
| 23 | L | 22 | 61 | 9 | 8 | 1264 | 877 |
| 24 | M | 24 | 62 | 8 | 6 | 1201 | 845 |
| 25 | N | 17 | 65 | 11 | 7 | 1220 | 892 |

| | Product plate | | | | Amount of diffusible | | |
|---|---|---|---|---|---|---|---|
| No. | YR (%) | El (%) | *1 | Surface quality | hydrogen (Mass ppm) | Welding cracking | Remarks |
| 1 | 69 | 14 | 16133 | Good | 0.12 | ○ | Invented example |
| 2 | 67 | 14 | 16133 | Good | 0.34 | X | Comparative example |
| 3 | 77 | 10 | 11020 | Failure | 0 | ○ | Comparative example |
| 4 | 65 | 14 | 13298 | Good | 0.04 | ○ | Comparative example |
| 5 | 70 | 13 | 15000 | Good | 0.14 | ○ | Invented example |
| 6 | 69 | 14 | 16133 | Good | 0.32 | X | Comparative example |
| 7 | 69 | 14 | 16133 | Good | 0.13 | ○ | Invented example |
| 8 | 71 | 14 | 16133 | Good | 0.03 | ○ | Invented example |
| 9 | 67 | 11 | 13335 | Good | 0.10 | ○ | Invented example |
| 10 | 68 | 16 | 16740 | Good | 0.04 | ○ | Comparative example |
| 11 | 73 | 7 | 9035 | Good | 0.01 | X | Comparative example |
| 12 | 68 | 17 | 18398 | Slightly good | 0.19 | ○ | Invented example |
| 13 | 82 | 10 | 13253 | Good | 0.02 | ○ | Invented example |
| 14 | 67 | 13 | 16075 | Slightly good | 0.18 | ○ | Invented example |
| 15 | 68 | 13 | 15850 | Slightly good | 0.18 | ○ | Invented example |
| 16 | 67 | 13 | 16075 | Slightly good | 0.12 | ○ | Invented example |
| 17 | 72 | 13 | 15900 | Slightly good | 0.00 | ○ | Invented example |
| 18 | 75 | 11 | 12075 | Good | 0.02 | ○ | Comparative example |
| 19 | 81 | 13 | 13250 | Good | 0.18 | ○ | Comparative example |
| 20 | 85 | 9 | 11764 | Failure | 0.04 | X | Comparative example |
| 21 | 68 | 11 | 13031 | Good | 0.11 | X | Comparative example |
| 22 | 68 | 10 | 11885 | Good | 0.12 | X | Comparative example |
| 23 | 69 | 14 | 17064 | Slightly good | 0.08 | ○ | Invented example |
| 24 | 70 | 13 | 15013 | Good | 0.05 | ○ | Invented example |
| 25 | 73 | 14 | 16470 | Good | 0.02 | ○ | Invented example |

*1: TS × (El + 3 − 2.5t)
F: Ferrite,
M: Martensite,
B: Bainite,
Retained γ: Retained austenite

INDUSTRIAL APPLICABILITY

The high-strength galvanized steel sheet according to embodiments of the present invention has not only a high tensile strength but also a high yield strength ratio and excellent ductility, and is also excellent in hydrogen embrittlement resistance and surface appearance quality of the material. For this reason, if the high strength member obtained using the high-strength galvanized steel sheet according to aspects of the present invention is used for the frame members of an automobile body, in particular, for the parts around a cabin, it contributes to an improvement in safety performance and to a decrease in the weight of an automobile body through an improvement in strength and a decrease in thickness. As a result, aspects of the present invention can contribute to environment conservation, for example, from the viewpoint of $CO_2$ emission. In addition, since the high-strength galvanized steel sheet according to aspects of the present invention has both good surface appearance quality and coating quality, it is possible to actively use for parts such as chassis which are prone to corrosion due to rain or snow. For this reason, according to aspects of the present invention, it is also possible to expect an improvement in the rust prevention capability and corrosion resistance of an automobile body. Such properties can effectively be used not only for automotive parts but also in the industrial fields of civil engineering, construction, and home electrical appliances.

The invention claimed is:

1. A high-strength galvanized steel sheet comprising:

a steel sheet having a chemical composition containing, in mass %,

C: 0.10% or more and 0.30% or less,

Si: 1.0% or more and 2.8% or less,

Mn: 2.1% or more and 3.5% or less,

P: 0.010% or less,

S: 0.001% or less,

Al: 1% or less,

N: 0.0001% or more and 0.006% or less, and the balance: Fe and incidental impurities, and a steel structure containing, in terms of area ratio, 4% or more and 20% or less of retained austenite, 10% or more and 30% or less of ferrite, 40% or more of martensite, and 10% or more and 50% or less of bainite, a balance of the steel structure other than the ferrite, the retained austenite, the martensite, and the bainite being 10% or less in terms of area ratio; and a galvanized layer provided on the steel sheet, wherein an amount of diffusible hydrogen in the steel is less than 0.20 mass ppm, a tensile strength is 1100 MPa or more, a relationship between a tensile strength TS (MPa), an elongation El (%), and a sheet thickness t (mm) satisfies a (1) formula below, and a yield ratio YR is 67% or more, $$TS\times(El+3-2.5t)\leq 13000 \quad (1).$$

2. The high-strength galvanized steel sheet according to claim 1, wherein the chemical composition further contains at least one of, in mass %, one or more of Ti, Nb, V, and Zr: 0.005% or more and 0.10% or less in total, one or more of Mo, Cr, Cu, and Ni: 0.005% or more and 0.5% or less in total, and B: 0.0003% or more and 0.005% or less, at least one of Sb: 0.001% or more and 0.1% or less and Sn: 0.001% or more and 0.1% or less, and Ca: 0.0010% or less.

3. A high strength member, obtained by subjecting the high-strength galvanized steel sheet according to claim 2 to at least either one of forming and welding.

4. A method for manufacturing the high-strength galvanized steel sheet according to claim 2, the method comprising:

an annealing step of heating a cold rolled steel sheet having the chemical composition according to claim 2 in an atmosphere in the furnace with a hydrogen concentration of 1 vol % or more and 13 vol % or less, in a temperature region of a temperature in the annealing furnace T1 of (an $A_{c3}$ point −10° C.) or more and 900° C. or less for 5 s or more, then performing cooling, and allowing the cold rolled steel sheet to retain in a temperature region of 400° C. or more and 550° C. or less for 20 s or more and 1500 s or less;

a coating step of subjecting a steel sheet after the annealing step to coating treatment, and performing cooling down to 100° C. or less at an average cooling rate of 3° C/s or more;

after the coating step, temper rolling is optionally performed at an extension rate of 0.1% or more; and a post-heat treatment step of allowing a coated steel sheet after the coating step to retain in an atmosphere in the furnace with a hydrogen concentration of 10 vol % or less and a dew-point temperature of 50° C. or less, at a temperature T2 (° C.) of 70° C. or more and 450° C. or less for a time t (hr) that is 0.02 or more (hr) and satisfies a (2) formula or more, $$135-17.2\times\ln(t)\leq T2 \quad (2).$$

5. A method for manufacturing a high strength member, comprising a step of performing at least either one of forming and welding on a high-strength galvanized steel sheet manufactured by the method for manufacturing a high-strength galvanized steel sheet according to claim 4.

6. The method for manufacturing a high-strength galvanized steel sheet according to claim 4, wherein width trimming is performed after the post-heat treatment step, and/or before the post-heat treatment step, and a retaining time t (hr) for retaining at a temperature T2 (° C.) of 70° C. or more and 450° C. or less in the post-heat treatment step is 0.02 or more (hr) and satisfies a (3) formula, $$130-17.5\times\ln(t)\leq T2 \quad (3).$$

7. A method for manufacturing a high strength member, comprising a step of performing at least either one of forming and welding on a high-strength galvanized steel sheet manufactured by the method for manufacturing a high-strength galvanized steel sheet according to claim 6.

8. The method for manufacturing a high-strength galvanized steel sheet according to claim 4, comprising, before the annealing step, an pre-treatment step of heating the cold rolled steel sheet up to an $A_{c1}$ point or more (the $A_{c3}$ point +50° C.) or less and performing pickling, and after the coating step, temper rolling is optionally performed at an extension rate of 0.1% or more.

9. A method for manufacturing a high strength member, comprising a step of performing at least either one of forming and welding on a high-strength galvanized steel sheet manufactured by the method for manufacturing a high-strength galvanized steel sheet according to claim 8.

10. The method for manufacturing a high-strength galvanized steel sheet according to claim 8, wherein width trimming is performed after the post-heat treatment step, and/or before the post-heat treatment step, and a retaining time t (hr) for retaining at a temperature T2 (° C.) of 70° C. or more and 450° C. or less in the post-heat treatment step is 0.02 or more (hr) and satisfies a (3) formula, $$130-17.5\times\ln(t)\leq T2 \quad (3).$$

11. A method for manufacturing a high strength member, comprising a step of performing at least either one of forming and welding on a high-strength galvanized steel sheet manufactured by the method for manufacturing a high-strength galvanized steel sheet according to claim 10.

12. A high strength member, obtained by subjecting the high-strength galvanized steel sheet according to claim 1 to at least either one of forming and welding.

13. A method for manufacturing the high-strength galvanized steel sheet according to claim 1, the method comprising:

an annealing step of heating a cold rolled steel sheet having the chemical composition according to claim 1 in an atmosphere in the furnace with a hydrogen concentration of 1 vol % or more and 13 vol % or less, in a temperature region of a temperature in the annealing furnace T1 of (an $A_{c3}$ point −10° C.) or more and 900° C. or less for 5 s or more, then performing cooling, and allowing the cold rolled steel sheet to retain in a temperature region of 400° C. or more and 550° C. or less for 20 s or more and 1500 s or less;

a coating step of subjecting a steel sheet after the annealing step to coating treatment, and performing cooling down to 100° C. or less at an average cooling rate of 3° C/s or more;

after the coating step, temper rolling is optionally performed at an extension rate of 0.1% or more; and a post-heat treatment step of allowing a coated steel sheet after the coating step to retain in an atmosphere in the furnace with a hydrogen concentration of 10 vol % or less and a dew-point temperature of 50° C. or less, at a temperature T2 (° C.) of 70° C. or more and 450° C. or less for a time t (hr) that is 0.02 or more (hr) and satisfies a (2) formula or more, $$135-17.5\times\ln(t)\leq T2 \quad (2).$$

14. A method for manufacturing a high strength member, comprising a step of performing at least either one of forming and welding on a high-strength galvanized steel sheet manufactured by the method for manufacturing a high-strength galvanized steel sheet according to claim 13.

15. The method for manufacturing a high-strength galvanized steel sheet according to claim 13, wherein width trimming is performed after the post-heat treatment step, and/or before the post-heat treatment step, and a retaining time t (hr) for retaining at a temperature T2 (° C.) of 70° C. or more and 450° C. or less in the post-heat treatment step is 0.02 or more (hr) and satisfies a (3) formula, $$130-17.5\times\ln(t)\leq T2 \quad (3).$$

16. A method for manufacturing a high strength member, comprising a step of performing at least either one of forming and welding on a high-strength galvanized steel sheet manufactured by the method for manufacturing a high-strength galvanized steel sheet according to claim 15.

17. The method for manufacturing a high-strength galvanized steel sheet according to claim 13, comprising, before the annealing step, an pre-treatment step of heating the cold rolled steel sheet up to an $A_{c1}$ point or more (the $A_{c3}$ point +50° C.) or less and performing pickling, and after the coating step, temper rolling is optionally performed at an extension rate of 0.1% or more.

18. A method for manufacturing a high strength member, comprising a step of performing at least either one of forming and welding on a high-strength galvanized steel sheet manufactured by the method for manufacturing a high-strength galvanized steel sheet according to claim 17.

19. The method for manufacturing a high-strength galvanized steel sheet according to claim 17, wherein width trimming is performed after the post-heat treatment step, and/or before the post-heat treatment step, and a retaining time t (hr) for retaining at a temperature T2 (° C.) of 70° C. or more and 450° C. or less in the post-heat treatment step is 0.02 or more (hr) and satisfies a (3) formula, $$130-17.5\times\ln(t)\leq T2 \quad (3).$$

20. A method for manufacturing a high strength member, comprising a step of performing at least either one of forming and welding on a high-strength galvanized steel sheet manufactured by the method for manufacturing a high-strength galvanized steel sheet according to claim 19.

* * * * *